United States Patent [19]

Butler

[11] 4,033,499

[45] July 5, 1977

[54] FASTENER APPLICATORS

[76] Inventor: David J. Butler, 1324 SE. 37th Lane, Cape Coral, Fla. 33904

[22] Filed: Oct. 20, 1975

[21] Appl. No.: 623,814

[52] U.S. Cl. ..... 227/120; 29/798; 29/816

[51] Int. Cl.[2] ..... B25C 1/00

[58] Field of Search ..... 29/432, 200 H, 211 M, 29/212 R; 227/120, 18, 76, 16, 93

[56] References Cited

UNITED STATES PATENTS

| | | | |
|---|---|---|---|
| 2,463,507 | 3/1949 | Barclay | 227/133 |
| 2,886,815 | 5/1959 | Young | 227/120 |
| 3,084,344 | 4/1963 | Schmidt | 227/18 |
| 3,193,167 | 7/1965 | Newton | 227/134 X |
| 3,310,215 | 3/1967 | Bostick | 227/111 |
| 3,319,864 | 5/1967 | Adams | 227/76 |
| 3,345,546 | 10/1967 | Beltramo | 227/131 |
| 3,385,498 | 5/1968 | Downie | 227/18 |
| 3,595,460 | 7/1971 | Pitkin | 227/112 X |
| 3,734,377 | 5/1973 | Munn | 227/120 |
| 3,935,983 | 2/1976 | Buttriss | 227/120 X |

*Primary Examiner*—Victor A. DiPalma

*Attorney, Agent, or Firm*—Michael Williams

[57] ABSTRACT

A tool for driving staples or nails and simultaneously providing reinforcement therefore. The tool is particularly useful in installing roofing material, although it has equal utility in attaching labels, tags and the like to shipping cases, and siding to buildings, and other purposes.

In a preferred embodiment, the tool is provided with a handle which is long enough that a workman may operate the tool without bending over any material amount. The staple or nail driving mechanism may be of the hand-driven type or may be air, electric or spring operated. Connected to the housing of the driving mechanism is a magazine containing a considerable number of fastener reinforcing elements, such as thin metal discs, through which the staple or nail is driven in the same stroke used to drive such fastener into the object to be fastened. In one embodiment of the invention, a coil of thin sheet metal is rotatably disposed within a housing carried by the driving mechanism housing, the leading edge of the strip being fed into position and sheared into tab form, the staple or nail then being driven through the tab.

2 Claims, 11 Drawing Figures

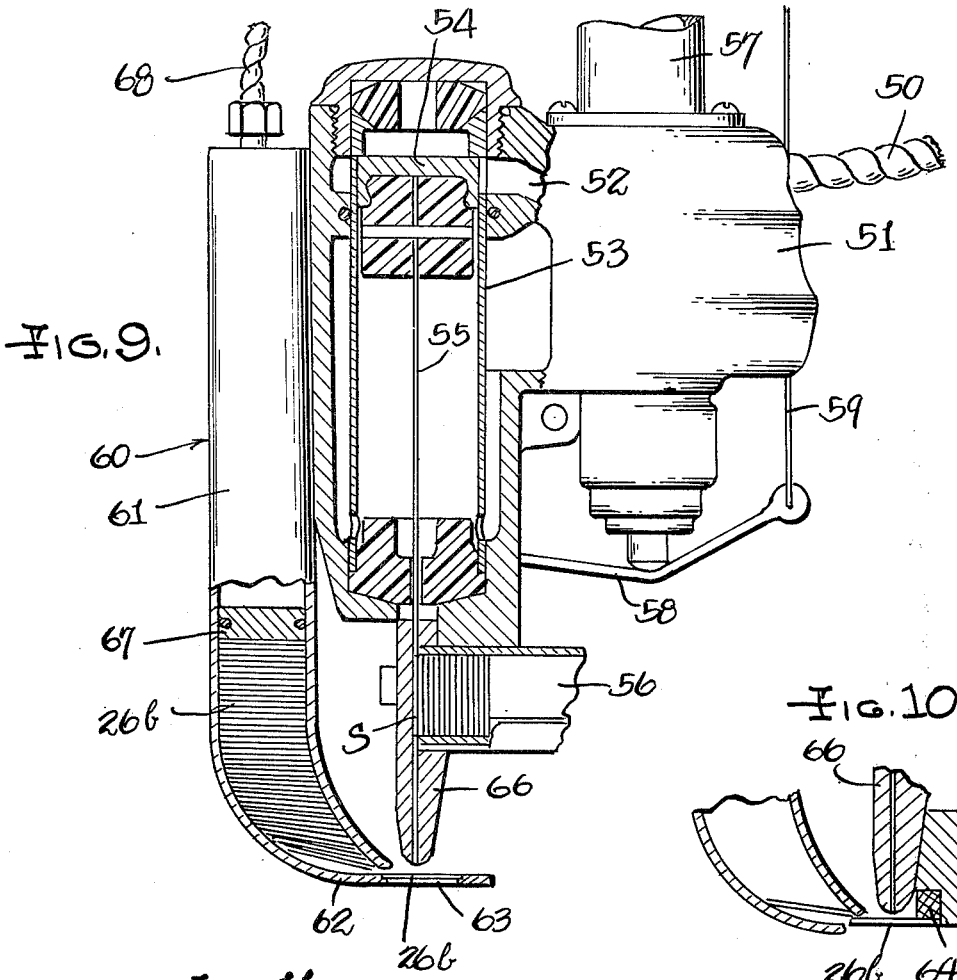
FIG. 9.
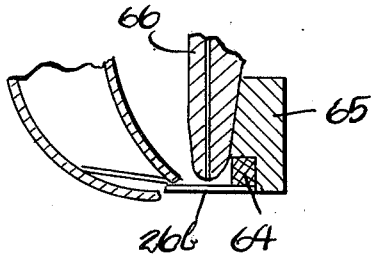
FIG. 10.
FIG. 11.
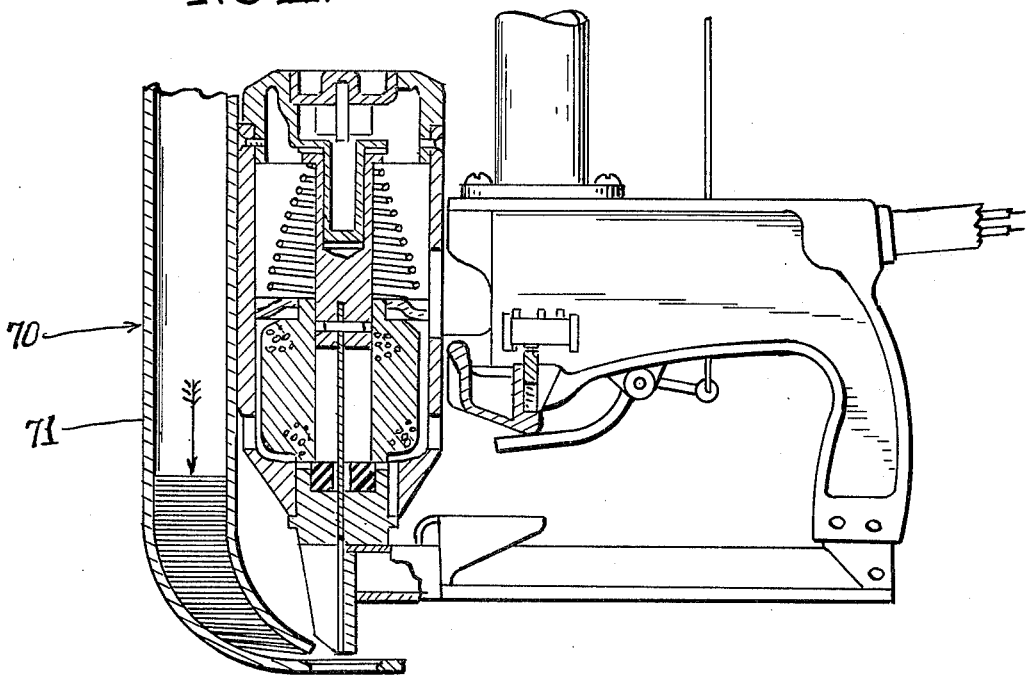

FASTENER APPLICATORS

BACKGROUND AND SUMMARY

The prior art contains many patents which disclose staple or nail driving mechanisms for various uses. However, these mechanisms merely drive the staple or nail without providing any reinforcement for the same.

In many applications, staple or nail reinforcement is not only desirable, but is necessary. For example, in applying roofing material to a building, such material is held in place only by the relatively thin span of the bight of the staple, or by the relatively small head of a roofing nail.

The fastener, such as the staple or fastener, when used alone is insufficient to properly hold down the under or first layer of roofing material. Therefore, the heavy build-up roofing that is attached to the first or thin under layer by hot tarring or other adhesive will not have a firm anchor and will come loose, especially in high winds.

My invention provides a tool that may be easily used by a workman without painful stooping or bending. The invention provides a supply of thin metal discs or tabs which are individually fed to a position wherein the driven staple or nail penetrates the same in a single driving operation. The discs or tabs, which may be made of any suitable rigid material, provide a larger area between the staple bight or nail head and the material to be fastened and thus prevent the bight or head from being driven through the material to the background to which it is fastened, and to better resist deterioration of the material due to weathering, or resist damage by wind storms and the like.

DESCRIPTION OF THE DRAWINGS

In the drawings accompanying this specification and forming a part of this application, there are shown, for purposes of illustration, several embodiments which my invention may assume, and in these drawings:

FIG. 9 illustrates an embodiment of my invention wherein the fastening element is driven into a workpiece by apparatus operated by compressed air, FIG. 10 illustrates a fragmentary modification of the construction shown in FIG. 9, and FIG. 11 is a fragmentary, sectional view of another embodiment of my invention, wherein the fastening element is driven into the workpiece by electric-operated apparatus.

DESCRIPTION OF THE PREFERRED EMBODIMENT

Figure 1:
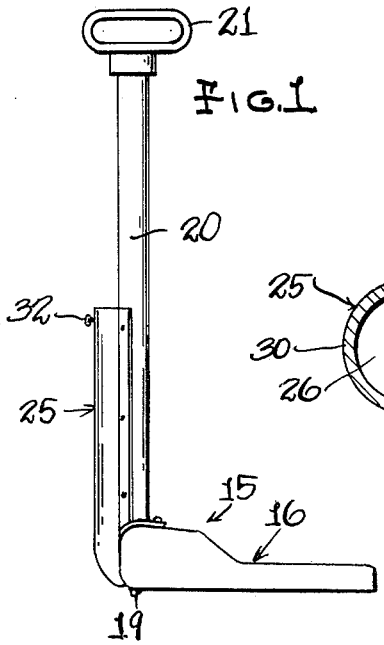
FIG. 1 is a small scale elevational view of one embodiment of my invention.
Figure 3:
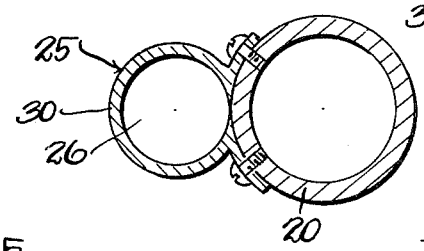
FIG. 3 is an enlarged, transverse sectional view corresponding to the line 3—3 of FIG. 2, FIGS. 4 and 5 are perspective views respectively illustrating staples and nails for cooperation with the dics dics or tabs.

In the embodiment of the invention disclosed in FIGS. 1 through 5, the staple driving apparatus 15 may be of the type shown in U.S. Pat. No. 2,463,507, issued to R. E. Barclay on Mar. 8, 1949, and reference is made to that patent for a complete disclosure of the mechanism. Briefly, the Barclay construction includes a casing 16 which houses a head unit 17 and the latter carries the operating mechanism.

Staples S are fed along a portion of the head unit so that successive ones are vertically aligned with a driver 18. A striker 19 is disposed to engage the work in advance of the head unit and through suitable leverage will cause the driver 18 to eject a staple with considerable force.

Attached to the casing 16 and extending upwardly therefrom is a tube 20 which terminates in a handle 21 forming a grip for the workman. The vertical distance from the lower surface of the head unit 17 to the handle 21 is about thirty to thirty-six inches, (0.76 to 0.92 meters) so that a workman may operate the tool without bending over an appreciable amount.

A magazine 25 is attached to the side of the tube 20 and is adapted to contain a considerable quantity of metal discs or tabs 26. These tabs may be formed of tin or galvanized steel and preferably have a diameter of about one and five-eighths inches (4.2 centimeters) and a thickness of about 0.013 inches (0.39 millimeters). It will be appreciated that the discs or tabs may be made of any other suitable material, and other suitable thickness and size.

The magazine 25 may take any suitable form and is constructed and arranged to eject a single tab 26 and dispose the latter for alignment with a staple S which is driven from the staple driver. Thus, a staple S is automatically driven through a tab 26 just prior to the time it is driven into the workpiece. In the case of applying roofing material to a roof, the tab will provide an enlarged area which will prevent the staple from being driven through the roofing material and will also provide a reinforcement so that high winds will not tear the roofing material from the staple, and especially after heavy or build-up roofing is attached to the first or under layer of roofing material, as before described.

In the form of the invention shown in FIGS. 1 through 5, the magazine 25 is in the form of an elongated tube 30 which is secured to the side of the tube 20. A compression spring 31 is interposed between a removable stop 32 and a cylindrical block 33 to constantly urge the stacked tabs 26 in a downward direction. The lower end 34 of the tube 30 is flattened to provide a rectilinear opening 35 which is of a size to closely but freely pass a single tab each time the staple driver is actuated to eject a staple S. It will be noted that the tube lower end 34 has a curved wall to cause proper feeding action of successive tabs 26. The heat unit 17 is provided with a permanent magnet 36 to releasably hold a tab 26 ejected from the magazine 25 in position to be penetrated by a staple S ejected from the driver mechanism.

Instead of staples, the driver mechanism may drive nails N (FIG. 5) in which case the head unit 17 will be modified to feed nails, instead of staples, to a driver, such as the driver 18. A suitable construction for this purpose is shown in U.S. Pat. No. 3,193,167, issued to A. E. Newton, on July 6, 1965. In such case, the tab feeding magazine 25 of the present invention would be secured to the side of the cylinder designated by the numeral 16 in the Newton patent, to deliver a tab 26 for penetration by an ejected nail.

DESCRIPTION OF OTHER EMBODIMENTS

Figure 6:
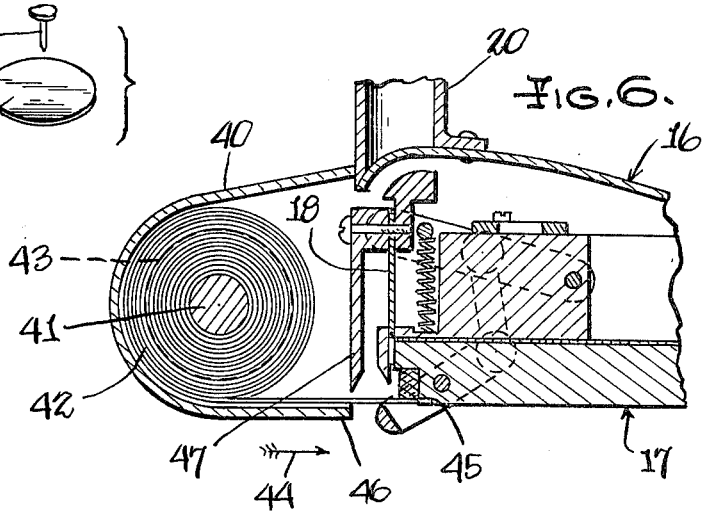
FIG. 6 is a fragmentary sectional view disclosing another embodiment of my invention.
Figure 7:
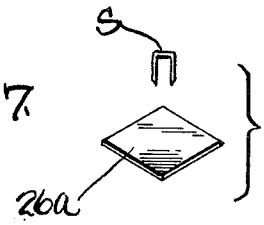
FIGS. 7 and 8 are perspective views illustrating the tabs resulting from the mechanism of FIG. 6 in association with staples and nails, respectively.
Figure 8:
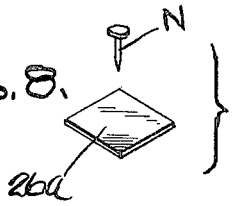

FIGS. 6 through 8 disclose another embodiment which my invention may assume, wherein the tabs 26*a* are cut from a roll of strip of any suitable material having a thickness substantially equal to the thickness of the tabs 26 heretofore described, or any other suitable thickness and size.

The driver mechanism may be the same as in the previously described embodiment to drive staples S, and the same reference numerals are used to describe like parts. Of course, if the mechanism is to drive nails N, it will be modified as suggested above.

In FIG. 6, a housing 40 is secured to the driver casing 16 or to the tube 20, or to both. A shaft 41 is journalled in bearings carried by opposite side walls of the housing 40, and the roll 42 of strip material is carried by the shaft 41 and held to rotation therewith. One of the side walls of the housing is removable, in conventional manner, so that the roll 42 may be replaced when necessary. The opposite wall of the housing 40 is provided with a key-wound torsion spring device 43 (also of conventional construction), so as to urge the leading end of the strip on the roll 42 in a direction of the arrow 44.

Figure 2:
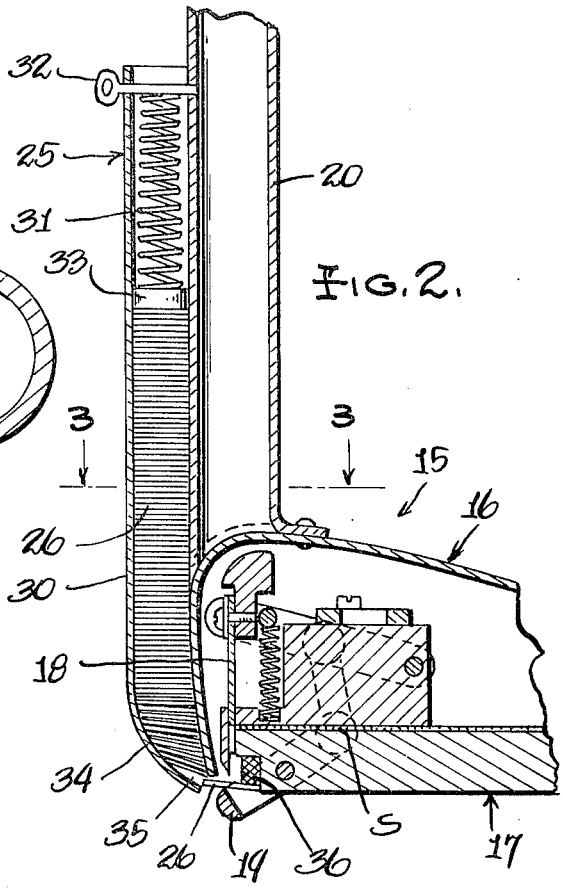
FIG. 2 is an enlarged, fragmentary sectional view of the lower part of the tool shown in FIG. 1.
Figure 4:
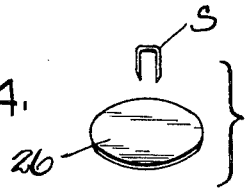
Figure 5:
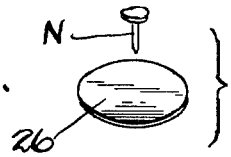

As seen in both FIGS. 2 and 6, the magnet 36 is inserted into the head unit 17 so as to form a shoulder 45 against which the tab 26 in FIG. 2, or the leading end of the strip in FIG. 6, abuts to predetermine the position of such parts. As seen in FIG. 6, the lower wall of the housing 40 provides an anvil 46 which is cooperable with a shear blade 47. The blade 47 is connected to the driver 18 and moves therewith, and is so disposed that its cutting edge engages and severs the strip just in advance of the staple ejection. In this embodiment, the tabs 26*a* are formed into substantially square shape, as seen in FIGS. 7 and 8.

The embodiments disclosed in FIG. 9 is adapted to be operated by compressed air and the staple-driving mechanism may take the form shown in U.S. Pat. No. 3,583,496, issued to Hellmuth Fehrs, on June 8, 1971, and reference is made to this patent for detailed construction. Briefly, air under pressure flows from a source, such as a compressor, through a hose 50 and into a valve housing 51 having a passage 52 leading to the upper end of a cylinder 53. A piston 54 is disposed for reciprocation within the cylinder and is driven downwardly therein when the valve mechanism (not shown) within the housing 51 directs compressed air through the passage 52. A drive-stem 55 is connected to the piston 54 and is operable to drive the end staple S, from a magazine 56, into the work.

A tube 57 (like tube 20) is connected to the valve housing and terminates in a handle as before. The valve within the housing 51 is operated by a trigger 58. In order that the trigger may be operated from the handle, a rod 59 has its lower end pivoted to the trigger, and its upper end slidably carried in the handle area by the handle or the upper end of the tube 57.

A magazine 60 is carried by the staple-driving mechanism and, as shown in FIG. 9 may take the form of a tube 61 which contains a plurality of vertically stacked tabs 26*b*. The lower end of the tube 61 is flattened and shaped to eject tabs in successive manner, as before. The lower horizontal wall 62 of the tube is extended to form a ledge upon which an ejected tab is supported, and this ledge may have a stepped opening 63 so that the tab is held in proper position in line with the driven staple, but is dislodged from the ledge by the driving force of the staple. The step in the opening 63 may be very slight so that the tab is not dished by the driving force of the staple.

Instead of the stepped opening, a permanent magnet 64 may be carried by a bracket 65 which is attached to the nozzle 66 of the staple-driving mechanism as shown in FIG. 10. The tabs 26*a* may be ejected from the magazine 60 by spring pressure, as before. However, since air pressure is available in the embodiment of FIG. 9, the disclosure thereof utilizes a piston 67 which is urged downwardly on the stack of tabs by air pressure admitted to the top of the magazine 60 by means of an air hose 68.

In the embodiment disclosed in FIG. 11, an electric-operated staple-driving mechanism is utilized, and this may take the form of the construction shown in U.S. Pat. No. 3,345,546, issued to R. M. Beltramo, on Oct. 3, 1967, and reference is made to this patent for details. The tab magazine 70 is similar to that shown in FIG. 9, although the tab ledge may also be modified as shown in FIG. 10. Further, the tabs may be urged downwardly within the magazine tube 71 by means of spring pressure, in the manner shown in FIG. 2.

Since in all of the disclosed embodiments, the staples or nails are ejected at relatively high velocity, it is desirable to provide a safety mechanism which will avoid accidental and unintentional operation of the fastener driving device. In the case of the pneumatic operation shown in FIG. 9, the safety mechanism may be controlled in the manner disclosed in U.S. Pat. No. 3,056,964, issued to W. R. Bleckman, et al., on Oct. 9, 1962. As therein shown, a safety plunger, identified in the patent by the numeral 107, engage the work and be shifted thereby to unlock a safety latch interlock before a fastener is ejected from the driving device. It will be appreciated that the same principle could be applied to the driving devices shown in FIGS. 2 and 11 of this application.

I claim:

1. A fastener applicator, adapted to be held against a workpiece during operation thereof, comprising:

apparatus for driving fasteners into said workpiece, including a driver movable through a drive stroke, a first magazine containing a plurality of fasteners, and means feeding individual fasteners to alignment with said driver so that upon movement of the latter through its drive stroke it strikes the aligned fastener and drives it from said driving apparatus and into said workpiece wherein an outer portion of said fastener overlies said workpiece, a second magazine connected to said driving apparatus and having a plurality of thin tabs stored therein, each tab having a surface area larger than said fastener outer portion.

said second magazine comprising an elongated tubular portion wherein the tabs are contained crosswise thereof and in face-to-face relation, said tubular portion having a tab-exit part curved in the direction toward the place where said individual fasteners are fed to alignment with said driver, said exit part terminating in a narrow slit through which individual tabs are fed for alignment with the driver and driven fastener.

2. The construction according to claim 1, wherein a handle is connected to said driving apparatus and extends upwardly therefrom for manipulation of the fastener applicator by a workman, said handle being of a length whereby said workman may operate said applicator without bending over an appreciable amount, said tubular portion lying alongside said handle and connected thereto.

* * * * *